United States Patent [19]

Lang et al.

[11] 4,325,594

[45] Apr. 20, 1982

[54] APPARATUS FOR SECURING A COVER TO AN AIR CONDITIONING UNIT

[75] Inventors: Richard D. Lang, Chittenango; Theodore S. Bolton, Liverpool, both of N.Y.

[73] Assignee: Carrier Corporation, Syracuse, N.Y.

[21] Appl. No.: 151,041

[22] Filed: May 19, 1980

[51] Int. Cl.[3] ..... A47B 43/00; A47B 81/00; H05K 5/00

[52] U.S. Cl. ..... 312/100; 312/257 A; 312/328; 174/52 R

[58] Field of Search ..... 312/100, 257 A, 257 SM, 312/257 SK, 328; 52/64; 174/52 R

[56] References Cited

U.S. PATENT DOCUMENTS

| | | | |
|---|---|---|---|
| 1,595,263 | 8/1926 | Thornberry | 312/328 |
| 1,860,224 | 5/1932 | Bode | 312/328 |
| 2,457,347 | 12/1948 | Casler et al. | 174/52 R |
| 2,506,533 | 5/1950 | Winborne | 312/328 |
| 2,656,948 | 10/1953 | McGee | 312/100 |
| 2,784,047 | 3/1957 | Wallance | 312/328 |
| 2,939,297 | 6/1960 | Karger et al. | 312/100 |
| 3,342,537 | 9/1967 | Nelson et al. | 312/100 |
| 3,479,104 | 11/1969 | Kobryner | 312/100 |
| 3,883,196 | 5/1975 | Mohr et al. | 312/257 A |
| 4,158,102 | 6/1979 | Bright | 312/100 |

*Primary Examiner*—Victor N. Sakran

*Attorney, Agent, or Firm*—J. Raymond Curtin; Robert P. Hayter

[57] ABSTRACT

Apparatus for securing a front cover to an air conditioning unit is disclosed. This apparatus includes a front cover having pivoting means and including a fastening lip for securing the unit in the closed position and a flange for securing the unit in the service position. An air conditioning unit assembly is additionally provided having a pivot means for coacting with the cover and a control panel extension for securing the flange of the cover to maintain the cover in the service position. A support lip is also provided for coacting with the fastening lip of the cover to maintain same in the closed position.

6 Claims, 6 Drawing Figures

APPARATUS FOR SECURING A COVER TO AN AIR CONDITIONING UNIT

BACKGROUND OF THE INVENTION

1. Field of the Invention

This invention in general relates to an air conditioning unit having a cover adapted to encase a portion thereof. More particularly, the present invention relates to means for securing a cover to an air conditioning unit including means for securing the cover in a service position wherein the filter may be changed and service access to portions of the unit is obtained.

2. Prior Art

Air conditioning units which are commonly used for light commercial applications such as hotels, dormitories and office buildings often are of the type known as a packaged terminal air conditioner. These packaged terminal air conditioners extend through the wall of the enclosure and normally have a condensing section located in communication with the ambient air for discharging heat energy. An evaporator section is provided in communication with the enclosure air for conditioning said air as it is drawn through the unit. Packaged terminal air conditioning units may be designed such that a portion of the unit is encased within the wall. The remaining portion of the unit is typically located within the enclosure to be conditioned. A cover may be provided for encasing the portion of the air conditioning unit located within the enclosure.

For normal maintenance operations it is desirable to have a cover which may be moved to allow access to the unit. In a conventional unit a cover is provided which may be assembled to the unit and removed therefrom. It is additionally desirable to have a cover that may be partially removed to allow access to the unit without complete removal of the cover and to allow service such as replacing or cleaning a filter without the complete removal of the cover.

SUMMARY OF THE INVENTION

An object of the present invention is to provide a cover for use with a packaged terminal air conditioning unit.

A further object of the present invention is to provide a cover for an air conditioning unit which has a closed position and a service position allowing access to the unit.

A further object of the present invention is to provide means for securing a cover to an air conditioning unit.

Another object of the present invention is to provide means for pivotally mounting an air conditioning unit cover to an air conditioning unit such that the cover may be rotated to various positions relative to the air conditioning unit.

Another object of the present invention is to provide a safe, economical, reliable, easy to manufacture, easy to assemble and easy to maintain air conditioning unit including a cover as described herein.

Other objects will be apparent from the description to follow and the appended claims.

The above objects are achieved according to a preferred embodiment of the invention by the provision of an air conditioning unit including a cover and an air conditioning unit assembly. The cover includes a front panel portion for extending across the front of the unit and two side portions, one on each edge of the unit. The front panel portion additionally includes a fastening lip for securing the cover to the unit in the closed position and a pivot opening adapted to provide means for rotating the cover. At least one side portion having a flange extending inwardly therefrom.

The air conditioning unit assembly includes a front support having a front support lip (also known as latching means) extending therefrom for engaging the fastening lip (also known as a latching element) of the cover for securing same to the unit. Additionally, the air conditioning unit has a pivot hook extending outwardly for engagement with the pivot opening of the cover, a vertical support for engaging the flange when the door is in the fully closed position and a control panel extension for guiding the side portion of the cover upon assembly and for engaging the cover flange to secure the door in a service position.

DESCRIPTION OF THE PREFERRED EMBODIMENT

The preferred embodiment herein described will refer to a cover and air conditioning unit subassembly for use as a packaged terminal air conditioning unit. It is to be understood that this invention has like applicability to other types of air conditioning units including self-contained units, fan coils and other similar applications.

Figure 1:
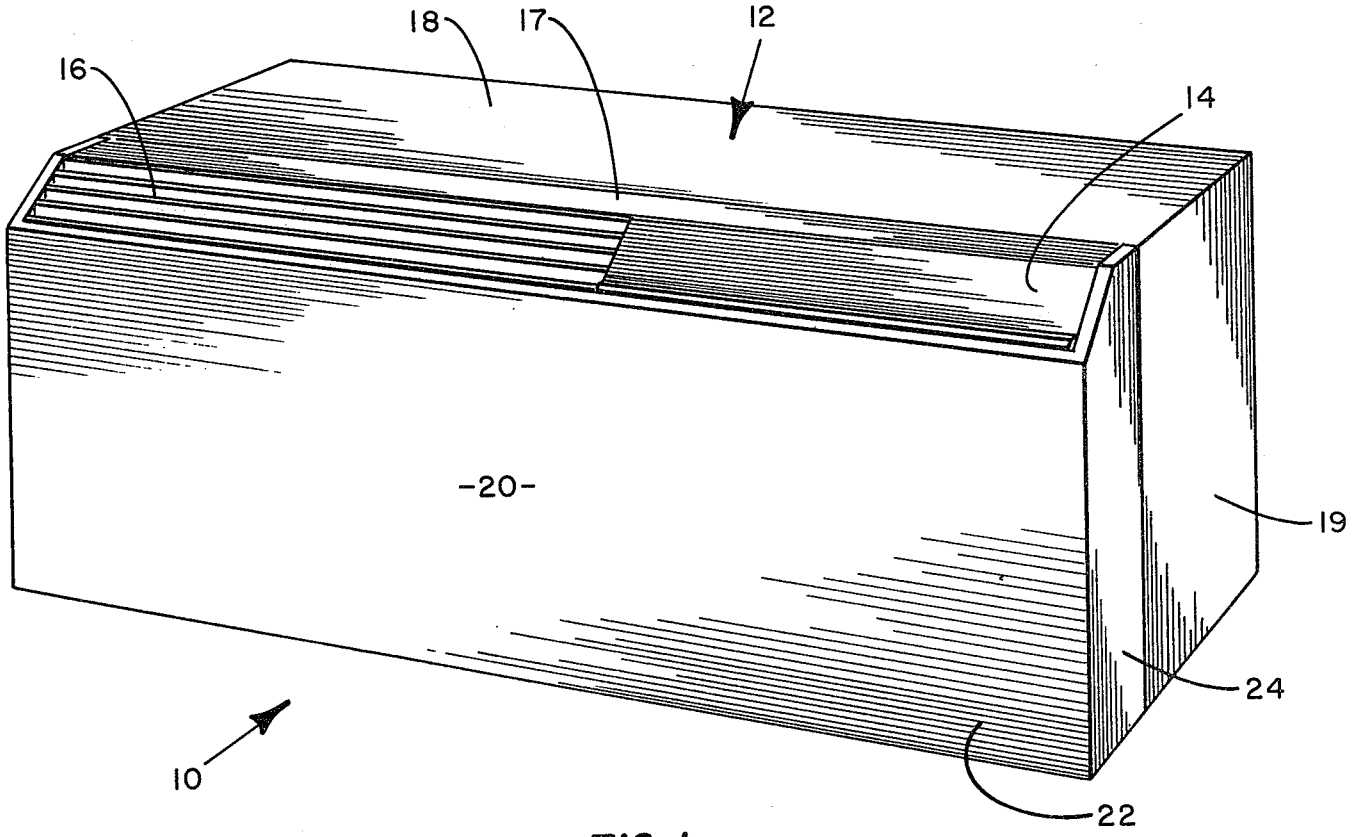
FIG. 1 is a perspective view of a packaged terminal air conditioning unit.

Referring first to FIG. 1 there may be seen a packaged terminal air conditioning unit having front cover 20. Front cover 20 has a front cover panel portion 22 and side portion 24. Casing 12 has a casing top 18 and casing side 19. The casing is typically mounted within the wall of an enclosure such that the front cover 20, top panel 17, grille 16 and control door 14 are visible to an occupant of the enclosure. Control door 14 is mounted for pivotal rotation and acts to cover the control portion of the unit. When the control door is raised the controls are accessible to the operator of the unit. Grille 16 mounted adjacent to control door 14 provides a space for the discharge of conditioned air into the enclosure. Top panel 17 extends the length of the unit adjacent control door 14 and grille 16.

As seen in FIG. 1, front cover 20 has side portions 24 having top edges configured to mate with the grille control door and top panel of the unit. The actual design of the side portion of the unit is adapted to coact with the remainder of the unit.

Figure 2:
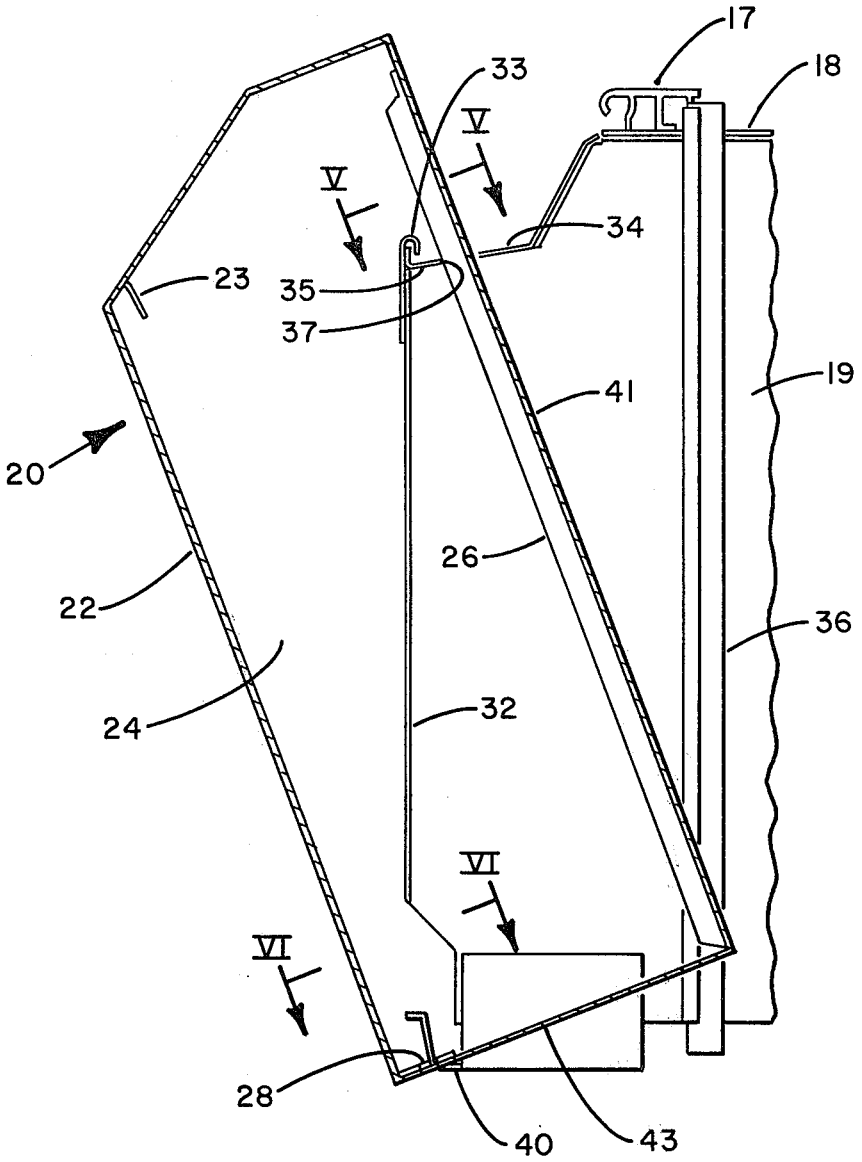
FIG. 2 is a partial side view of the air conditioning unit showing the cover in the service position.

Referring now to FIG. 2 there may be seen a partial end view of the front cover 20 and the remainder of the air conditioning unit. Front cover 20 is shown in the service position wherein it is partially rotated exposing some of the internal components of the unit including the filter. When rotated to this position, it is possible to remove the filter and to generally have access to the indoor air or evaporator side of the unit for maintenance or service.

Front cover 20 has a side portion 24 and front cover panel portion 22. Additionally, pivot opening 28 at the bottom of front cover 20 is adapted to receive pivot hook 40 extending from the unit. The bottom edge 43 of the side portion and rear edge 41 of the the side portion are referenced in FIG. 2. Front cover flange 26 extends toward the front cover panel portion 22 and inwardly toward the remainder of the unit from rear edge 41 of the side portion. Fastening lip 23 extends downwardly from the top of front panel portion 22 of the unit.

The indicated portions of the air conditioning unit include front support 32 and front support lip 33 extending therefrom. Control panel 34 located at the top of the unit may serve to support the various unit controls. Control panel extension 35 extends outwardly therefrom. Top panel 17 and casing top 18 as well as casing side 19 are also referenced in FIG. 2. An L-shaped vertical support 36 is additionally shown forming a border between casing side 19 and that portion of the unit covered when cover 20 is in the closed position.

Figure 3:
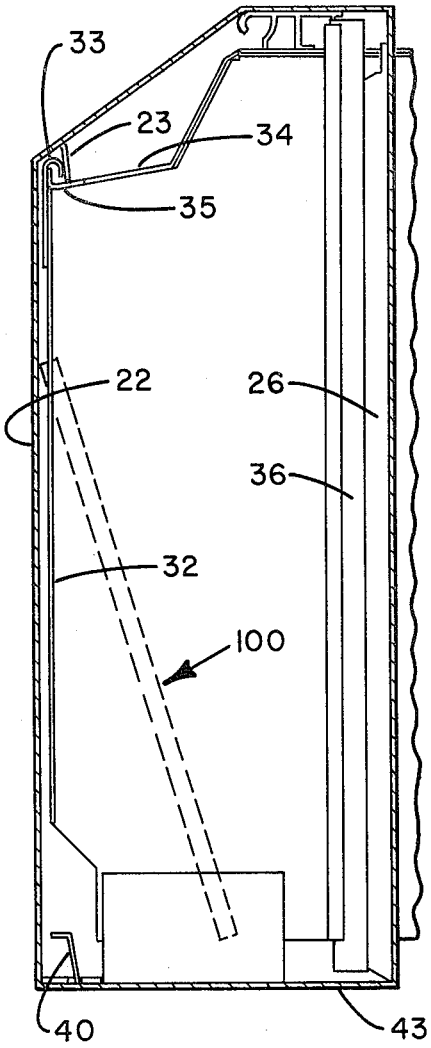
FIG. 3 is a partial side view of the unit showing the cover in the fully closed position.
Figure 4:
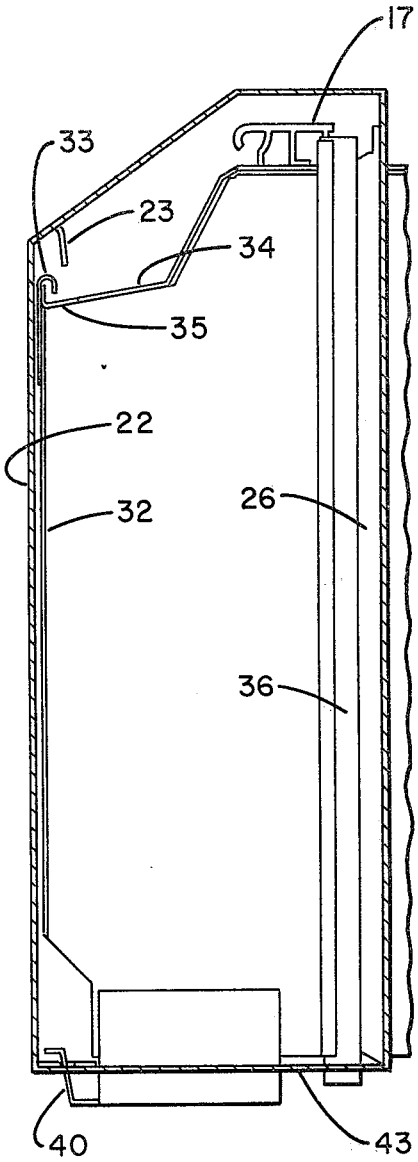
FIG. 4 is a partial side view of the unit showing the cover in a raised position just prior to rotation.

Referring now to FIGS. 3 and 4 there can be seen the front cover in the fully closed position. In this position pivot hook 40 extends through pivot opening 28 and front panel portion 22 is generally parallel with front support 32. Fastening lip 23 extends downwardly in contact with front support lip 33. The contact of the front support lip with the fastening lip acts to prevent the top of the unit from rotating from right to left as shown in FIGS. 2 through 4. The front cover 20 rests on pivot hook 40 to prevent the cover from moving downwardly. It can also be seen that flange 26 coacts with vertical support 36 such that an attractive unit is provided. Filter 100 is shown in phantom in FIG. 3 to designate the approximate location of the filter. It can be seen that when the cover is in the service position as shown in FIG. 2 it is possible to achieve access to the filter.

FIG. 3 shows the cover in the fully closed position with the cover being completely moved downwardly to its at rest position. FIG. 4 is identical to FIG. 3, however, the cover portion has been raised upwardly such that it may be rotated to the service position. The moving of the cover portion upwardly acts to raise fastening lip 23 such that it no longer engages support lip 33. Hence, the cover may now be rotated from right to left (counterclockwise). After the cover is moved upwardly with the pivot opening 28 sliding along pivot hook 40 until fastening lip 23 clears support lip 33, the cover may then be rotated to the service position as shown in FIG. 2. Once in this service position, the cover slides down pivot hook 40 and the bottom of the cover is resting against the bottom of the pivot hook. The control panel extension extending from control panel 34 acts to engage the flange of the cover such that further rotation from right to left is prevented.

Figure 5:
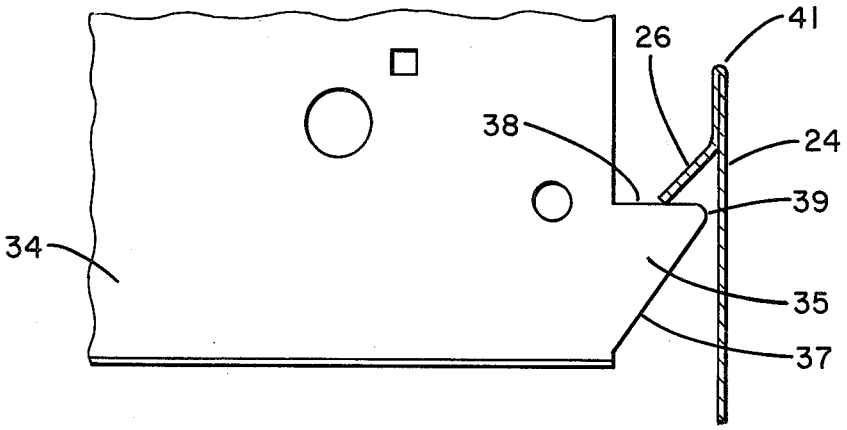
FIG. 5 is a partial sectional view of a portion of the control panel taken along line V—V of FIG. 2.

FIG. 5 is a sectional view of the control panel extension and the side portion of the front cover taken at line V—V in FIG. 2. It can be seen in this view that control panel 34 has a control panel extension 35 extending outwardly therefrom. Control panel extension 35 has a forward inclined guide edge 37, a position surface 39 and support edge 38. Front cover side portion 24 is shown having rear edge 41 and flange 26 extending inwardly therefrom. It can be seen in FIG. 5 that when the cover is rotated to the service position as shown in FIG. 2 that flange 26 engages support edge 38 of the control panel extension such that the cover is maintained in the service position. It can be additionally seen in FIG. 5 that guide edge 37 is inclined outwardly from control panel 34 such that upon assembly of the unit this guide edge acts to direct edge 41 of side portion 24 of the front cover outwardly around the control panel extension. This guide edge serves to center the front cover on the unit to facilitate assembly of the cover to the unit. Position surface 39 further acts to hold the front cover in the appropriate position by engaging the interior surface of side portion 24 of the front cover.

Figure 6:
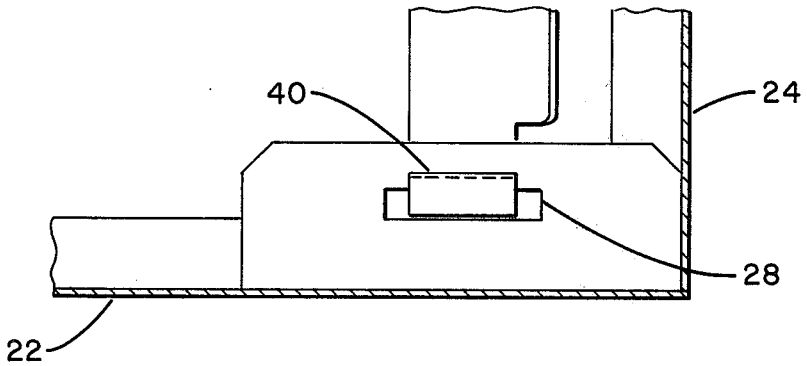
FIG. 6 is a partial sectional view of the pivot hook and pivot opening for securing the cover to the air conditioning unit taken along line VI—VI in FIG. 2.

FIG. 6 is a view taken along line VI—VI of FIG. 2 showing pivot hook 40 and pivot opening 28. The Figure additionally indicates front panel portion 22 of the front cover as well as side portion 24. It can be seen that pivot hook 40 extends upwardly through pivot opening 28 such that the front cover may both be rotated relative to the contact therebetween and slid upwardly along pivot hook 40 enabling the fastening lip to become disengaged from the front support lip.

The combination of elements described herein allows the front cover to be assembled by engaging pivot openings 28 with pivot hook 40. The cover is then rotated such that the fastening lip 23 clears front support lip 33. The cover is then slid downwardly along the pivot hook to the closed position with flange 26 engaging support 36. When it is desirable to rotate the front cover from the closed position to the service position, the front cover is slid upwardly along pivot hook 40 and then rotated from right to left such that the fastening lip 23 clears front lip 33. The unit is rotated until flange 26 engages support edge 38 of control panel extension 35 securing the cover in a service position.

The control panel extension may be bent downwardly such that the position surface 39 does not form a sharp projection which might otherwise penetrate the cover upon application of unusual forces against the cover.

The invention has been described herein in reference to a particular embodiment thereof. It is to be understood that variations and modifications can be effected within the spirit and scope of the invention.

We claim:

1. Apparatus for securing a cover to an air conditioning unit such that the cover has a closed position and a service position which comprises:

a cover including a front panel portion and at least one side portion, said front panel portion serving to cover at least a portion of the unit and said front panel portion having both latching means and pivot means associated therewith, and said side portion having an inwardly extending flange; and an air conditioning unit assembly including a front support adapted to be concealed by the front panel portion of the cover, said front support including a latching element for coacting with the latching means of the cover, pivot projection means extending from the assembly for coacting with the pivot means of the cover, and a control panel extension extending to engage the side portion of the cover to properly position the cover and to engage the flange of the cover to secure the cover in the service position.

2. The apparatus as set forth in claim 1 wherein the air conditioning unit assembly includes a control panel attached to the front support and wherein the control panel extension is formed from a portion of the control panel.

3. The apparatus as set forth in claim 1 wherein the control panel extension has a guide edge for directing the side portion of the cover upon assembly of the cover to the air conditioning unit assembly, a position surface for maintaining the side portion of the cover appropriately spaced relative to the air conditioning unit assembly and a support edge for engaging the cover flange to secure the cover in the service position.

4. The apparatus as set forth in claim 1 wherein the latching means comprises a front support lip attached to the front support and wherein the latching element is a fastening lip extending from the cover, the fastening lip engaging the front support lip to secure the cover in the closed position.

5. The apparatus as set forth in claim 1 wherein the pivot means of the cover includes a pivot opening and wherein the pivot projection means includes a pivot hook, whereby the cover may be assembled to the unit assembly with the pivot hook inserted into the pivot opening such that the cover may both rotate relative thereto and slide vertically in relation thereto.

6. The apparatus as set forth in claim 1 wherein the air conditioning unit assembly further comprises a vertical support positioned to cooperate with the cover flange when the cover is in the fully closed position.

* * * * *